United States Patent [19]

Jamison et al.

[11] 4,131,317

[45] Dec. 26, 1978

[54] MINING MACHINE HAVING ADVANCING MINE ROOF SUPPORTS

[75] Inventors: Will B. Jamison, Bethel Park, Pa.; Henry Fleck, Columbus, Ohio

[73] Assignee: Consolidation Coal Company, Pittsburgh, Pa.

[21] Appl. No.: 745,965

[22] Filed: Nov. 29, 1976

Related U.S. Application Data

[63] Continuation of Ser. No. 623,493, Oct. 17, 1975, abandoned, which is a continuation of Ser. No. 457,459, Apr. 3, 1974, abandoned.

[51] Int. Cl.[2] ..... E21C 25/06; E21C 25/52; E21C 29/22; E21D 15/44

[52] U.S. Cl. ..... 299/31; 299/11; 299/33; 299/57; 299/75; 299/87

[58] Field of Search ..... 299/31, 33, 57, 64, 299/73–75; 61/45 D

[56] References Cited

U.S. PATENT DOCUMENTS

| | | | |
|---|---|---|---|
| 2,920,879 | 1/1960 | Driehaus | 299/64 |
| 3,387,892 | 6/1968 | Fischer et al. | 299/31 |
| 3,647,262 | 3/1972 | Kacmarcy | 299/11 |
| 3,677,603 | 7/1972 | Small | 299/31 |
| 3,879,088 | 9/1973 | Sodder et al. | 299/31 |

*Primary Examiner*—Ernest R. Purser
*Assistant Examiner*—William F. Pate, III
*Attorney, Agent, or Firm*—William A. Mikesell, Jr.; Stanley J. Price, Jr.

[57] ABSTRACT

The mining machine has a body portion mounted on a pair of endless propelling tracks which advance the mining machine forwardly in the mine. Pairs of forwardly extending arm members are pivotally connected to the body portion and support at their end portions a skid plate which is positioned transversely across the body portion and arranged to rest on and slide over the mine floor. A first conveyor is supported by the skid plate and receives and directs dislodged material from the mine floor to a second conveyor connected to the end portion of the first conveyor. The second conveyor discharges the dislodged material to the rear of the body portion. A support frame is positioned on the skid plate and horizontally supports a pair of transverse guide rails at the front end of the body portion. A carriage is slidably mounted for transverse movement on the guide rails and includes a rotatable supporting shaft. A transverse support arm having axial spaced cutter shafts positioned thereon is secured to and rotatable with the supporting shaft. Forward movement of the body portion sumps the rotating cutter shafts into the mine face and by rotating the supporting shaft and feeding the carriage laterally on the guide rails a rectangular section is cut from the face. A first roof supporting apparatus supported by the body portion includes a vertically movable beam member arranged to engage the mine roof. A second roof supporting apparatus having vertically movable beam members is connected by piston cylinder assemblies to the body portion and is independently operable of the first roof supporting apparatus to support the mine roof when the first roof supporting apparatus is removed from engagement with the mine roof and advances forwardly with the body portion.

14 Claims, 16 Drawing Figures

MINING MACHINE HAVING ADVANCING MINE ROOF SUPPORTS

CROSS REFERENCES TO RELATED APPLICATIONS

This application is a continuation of copending application, Ser. No. 623,493, filed on Oct. 17, 1975, now abandoned entitled "Mining Machine Having Advancing Mine Roof Supports" which, in turn, is a continuation of application, Ser. No. 457,459, filed on Apr. 3, 1974, entitled "Mining Machine Having Advancing Mine Roof Supports", and now abandoned.

BACKGROUND OF THE INVENTION

1. Field of the Invention

This invention relates to a mining machine and more particularly to a mining machine that includes roof support units that support the mine roof while the mining machine is advancing into the mine face.

2. Description of the Prior Art

Mining machines having roof support units associated therewith are well known in the art as illustrated, for example, in United States Patents 3,006,624, 3,206,252 and 3,576,110. The mining machine is propelled by driven endless tracks or on skids to a position adjacent the mine face and rotary action of driven cutter chains or a drum cutter having cutting elements rotatable therewith continuously dislodge material from the face of the mine. During the mining operation, roof support members are extended by hydraulic jacks into engaging relationship with the mine roof to thereby support the mine roof during the mining operation. Conveying and gathering means are associated with the mining machine to remove the material dislodged from the face of the mine to permit the continuous mining of the material.

U.S. Pat. 3,677,603 illustrates a mine roof assembly having a shearing machine and a conveyor means associated therewtih for removing disintegrated material dislodged from the face as roof support assemblies support the mine roof. The forward operating portion of the machine includes a transverse beam member for supporting the roof adjacent the heading being cut. Additional roof support is provided by a rearward roof support assembly operative to advance forwardly towards the face when the assembly is released from between the roof and floor.

There is need for a mining machine operable to cut a kerf in the mine face by sumping the cutter shaft into the face and then feeding the cutter shaft laterally across the face with the provision of roof support units engaging the roof as the machine advances into the face.

SUMMARY OF THE INVENTION

In accordance with the present invention there is provided a mining machine which includes a body portion having pairs of arm members pivotally secured thereto and extending forwardly therefrom in spaced parallel relationship. Dislodging the apparatus is rotatably mounted on the front ends of the arm members and has a horizontal axis of rotation arranged to rotate about a longitudinal axis relative to said body portion. A conveying mechanism is pivotally connected to the front portion of the body portion adjacent the dislodging apparatus and transfers material dislodged from the face by the dislodging apparatus to the rear portion of the body portion. A guide mechanism for supporting the dislodging apparatus adjacent the mine face is positioned forward of the arm members and extends transversely therebetween. The guide mechanism is positioned with the dislodging apparatus on the front portion of the body portion for vertical movement to a preselected height above the body portion. The dislodging apparatus is arranged to move transversely relative to the body portion on the guide mechanism and cut a rectangular section from the mine face. A first roof supporting apparatus is supported by the body portion and is operable upon actuation to move into and out of abutting relation with the mine roof. A second roof supporting apparatus is connected to the body portion and is independently operable of the first roof supporting apparatus to support the mine roof as the body portion and the dislodging apparatus advance forwardly.

The guide mechanism includes a carriage that is slidably mounted on guide rails which extend transversely across the front portion of the body portion. Rotatably mounted within the carriage is an axial supporting shaft to which is secured a rotatable support arm. The rotatable support is provided with a pair of cutter shafts positioned at opposite ends of the support arm and in horizontal relationship with the mine floor. Each of the cutter shafts includes a scroll-type cutting element extending outwardly from the periphery of the cutter shaft. Independent drive motors rotate the cutting elements and the cutter shafts at high speed as the support arm rotates about the axis of the axial supporting shaft. In this manner, the cutter shafts rotate independent of the axial supporting shaft and orbit the axial supporting shaft as the support arm rotates therewith to continuously dislodge solid material from the mine face.

The first and second roof supporting apparatus include horizontal beam members which are moved vertically into and out of engagement with the mine roof by hydraulic jack units. While the cutter shafts are moved transversely by the carriage to cut a horizontal kerf in the face, both the first and second roof supporting apparatus are maintained in abutting contact with the mine roof. However, as the body portion and the cutter shafts advance forwardly into the mine face, the first roof supporting apparatus is removed from contact with the roof. The second roof supporting apparatus remains in abutting contact with the mine roof. The second roof supporting apparatus is connected to the body portion by extensible piston cylinder assemblies which upon actuation permit the second roof supporting apparatus to remain fixed relative to the body portion as it advances forwardly during the sumping operation. In this manner, the mine roof is supported continuously while the mining machine dislodges material from the face.

Accordingly, the principal object of this invention is to provide a mining machine having roof support apparatus for continuously supporting the mine roof as material is dislodged from the mine face by the mining machine and as the mining machine advances forwardly into the mine face.

Another object of the present invention is to provide a mining machine having a conveying apparatus for continuously removing dislodged material from the face and apparatus for supporting the roof of the mine as the mining machine advances forwardly into the face.

Still another object of the present invention is to provide roof drilling units associated with each of the roof supporting units to permit simultaneous drilling of bores into the roof for the installation of roof bolts while the mining machine is dislodging material from the face.

These and other objects and advantages of this invention will be more completely disclosed and described in the following specification, the accompanying drawings and the appended claims.

DESCRIPTION OF THE PREFERRED EMBODIMENTS

Figure 1:
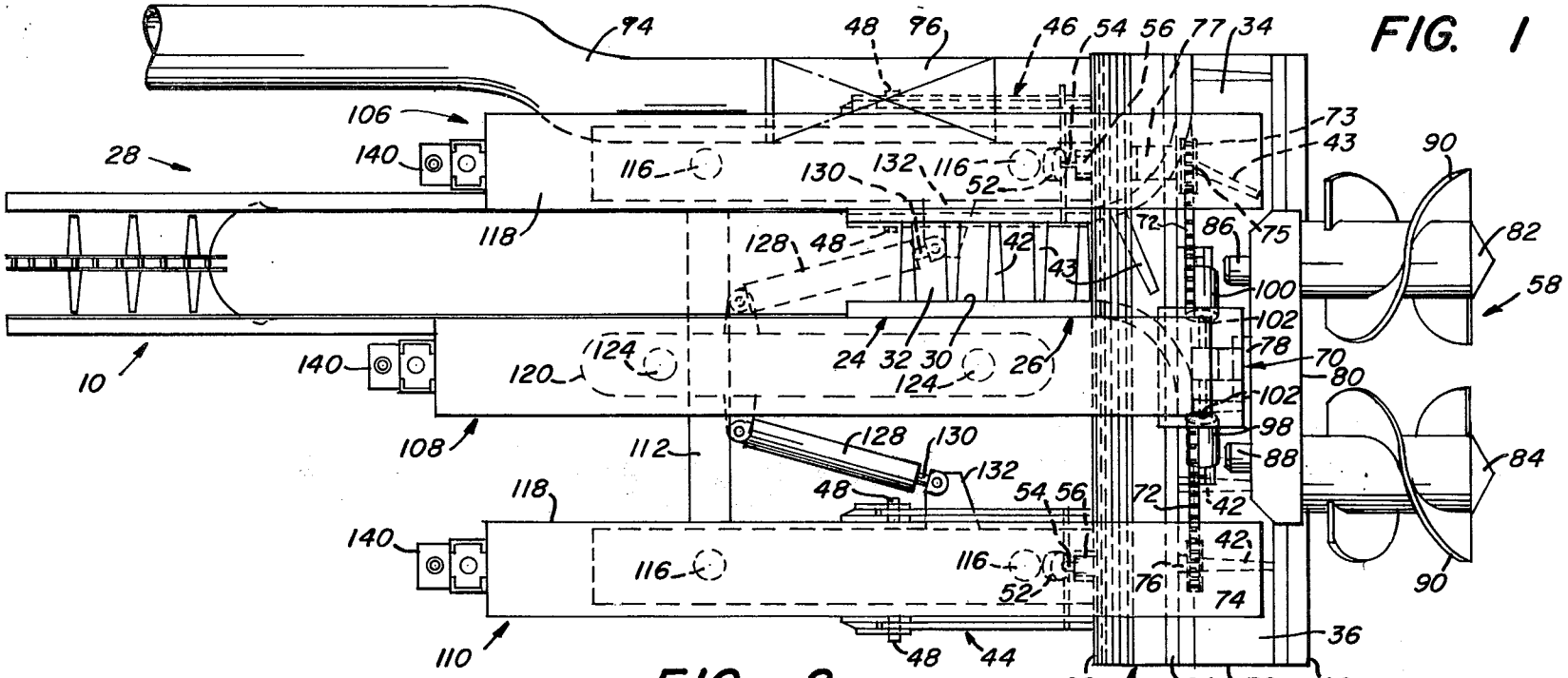
FIG. 1 is a top plan view of the mining machine, illustrating the adjustable roof supports for supporting the mine roof as the mining machine advances during the mining operation.
Figure 2:
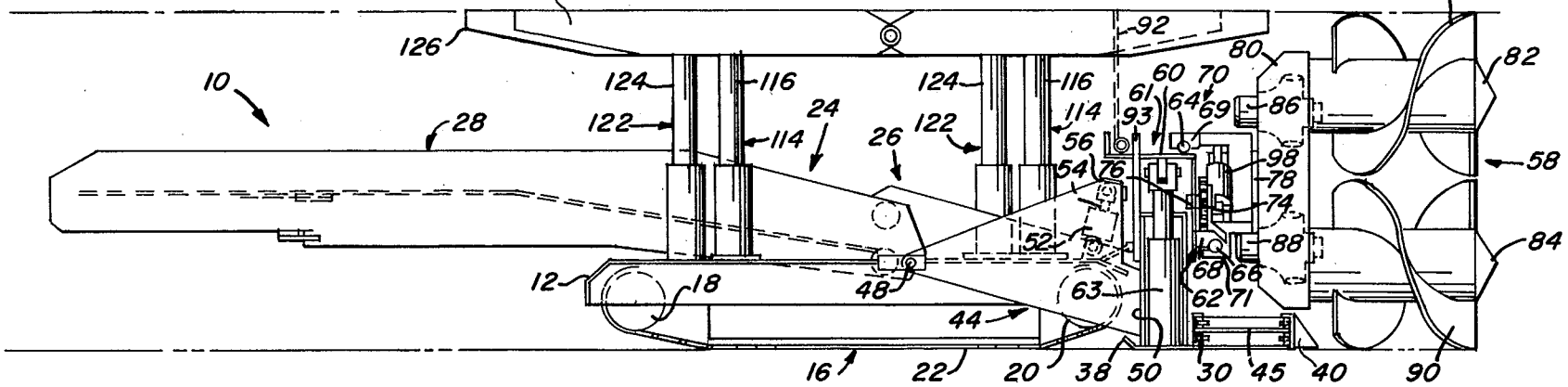
FIG. 2 is a view in side elevation of the mining machine illustrated in FIG. 1 in which the cutter shafts are shown in substantially vertical alignment having been rotated to a vertical position.

Referring to the drawings, and more particularly to FIGS. 1 and 2, there is illustrated a mining machine generally designated by the numeral 10 that has a body portion 12 on which a pair of endless track propelling devices 16 are mounted. The propelling devices 16 include a pair of sprockets 18 and 20 rotatably mounted on the body portion 12 and are arranged to rotatably support the ground engaging tracks 22 passing around the sprockets 18 and 20. With this arrangement, the endless track propelling devices 16 propel the mining machine 10 within the mine and also advance and retract the dislodging apparatus of the machine hereinafter described.

The mining machine 10 is provided with a gathering and conveying apparatus generally designated by the numeral 24 that includes a scraper chain conveyor 26 connected to a flight conveyor 28. The scraper chain conveyor 26 has a trough 30 which includes a longitudinally extending portion 32 and a pair of opposed branches 34 and 36 that extend transversely across the front of the body portion 12. The trough branches 34 and 36 are supported by a skid plate 38 that is arranged to rest on and slide over the mine floor as the mining machine 10 advances into the face. The front edge of the skid plate 38 has an inclined material receiving portion 40 that extends forwardly of the trough branches 34 and 36 to receive and direct dislodged material from the mine floor to the trough 30.

The scraper chain conveyor 26 has separate pairs of chain elements 42 and 43 which travel over the surface of the skid plate 38 and a horizontal base plate 45 of the trough 30. The dislodged material directed by the inclined portion 40 into the trough 30 is transported by the elements of scraper chains 42 and 43 from the branch portion 34 and 36 to the longitudinally extending portion 32. The end of the scraper chain conveyor 26 is positioned in overlying relation with the front end portion of the other conveyor 28. Thus, the conveyor 28 receives the dislodged material from the scraper chain conveyor 26 and transports the material to the rear of the body portion 12 and away from the face of the mine and into a material receiving vehicle. The conveyor 28 includes a discharge end portion arranged for pivotal movement to facilitate the discharge of dislodged material into the material receiving vehicle. It should be understood that the practice of the present invention is not restricted to the above disclosed conveyor system. Any other type of conveyor system that is operable to receive dislodged material at the mine face and direct it to the rear of the body portion during the continuous mining operation may be employed.

Pairs of parallel spaced boom arms generally designated by the numerals 44 and 46 are pivotally connected to the body portion 12 by pivot pins 48. A support frame 50 is carried by the front end portions of the boom arms 44 and 46 and is rigidly secured to the skid plate 38. Each of the boom arms 44 and 46 are provided with a piston cylinder assembly 52 mounted on the body portion 12 and have an extensible piston rod 54. The end portion of the piston rod 54 is connected to a clevis bracket 56 mounted on the upper end portion of each of the boom arms 44 and 46, as illustrated in FIGS. 1 and 2. With this arrangement, each of the piston cylinder assemblies 52 are operable upon actuation to extend the piston rods 54 to thereby pivot the boom arms 44 and 46 about the pivotal connections 48 and thus raise and lower the scraper chain conveyor 26 relative to the mine floor.

A rotatable cutter head generally designated by the numeral 58 is mounted forward of the body portion 12 for transverse movement relative to the mining machine body portion 12 as it dislodges solid material from the mine face. The cutter head 58 is slidably positioned on the horizontal and vertical plates 60 and 62 of a transversely extending frame generally designated by the numeral 61. The frame 61 is supported by a hydraulic jack unit 63 mounted on the skid plate 38 of the conveyor 26. The jack unit 63 has an extensible portion which is suitably pinned to the bottom surface of the horizontal plate 60. An upper guide bar 64 is secured to the top surface of the horizontal plate 60, and a lower guide bar 66 is positioned in a horizontal arm 68 which is secured to and projects forwardly from the vertical plate 62. The upper and lower guide bars 64 and 66 are thus positioned in spaced parallel relationship to each other and extend transversely across the front of the mining machine body portion 12.

A carriage generally designated by the numeral 70 has upper and lower arm portions 69 and 71 arranged for lateral transverse movement relative to the body portion 12 on the upper and lower guide bars 64 and 66. The upper arm portion 69 of the carriage 70 is slidably positioned on the upper guide bar 64, and the lower arm portion 71 is slidably positioned on the lower guide bar 66. Lateral movement of the carriage 70 on the upper and lower guide bars 64 and 66 is accomplished by rotation of a chain 72 reeved about sprockets 73 and 74. The sprockets 73 and 74 are positioned at opposite ends of the transversely extending frame 61 and are secured to shafts 75 and 76. The shaft 75 of sprocket 73 is rotated in a clockwise or counterclockwise direction by drive motor 77 that is secured to the frame 61. Shaft 76 is rotatably secured to the opposite end portion of the frame 61. The ends of the chain 72 are secured to opposite sides of the carriage 70. Thus, with this arrangement, the motor 77 rotates shaft 75 to provide for rotation of the chain 72 around sprockets 73 and 74. Rotation of the chain 72, in turn, moves the carriage 70 in a preselected direction transversely on the guide bars 64 and 66 between the lateral end portions of the mining machine body portion 12. In addition, operation of the hydraulic jack unit 63 raises the carriage 70 together with the cutter head 58 to a desired elevation above the mine floor for dislodging material at a preselected height in the mine face.

Positioned within the carriage 70 is a bearing block (not shown) having an axial supporting shaft 78 freely rotatable therein. A transverse support arm 80 is secured to and rotatable with the axial supporting shaft 78. Positioned at the end portions of the support arm 80 and arranged equidistant from the axis of rotation of the supporting shaft 78 are cutter shafts 82 and 84. A pair of drive motors 86 and 88 are provided on the support arm 80 and are connected to the cutter shafts 82 and 84 respectively. The drive motors 86 and 88 are capable of rotating the cutter shafts 82 and 84 in a preselected direction at a preselected speed. Preferably, the motors 86 and 88 are of the radial piston type hydraulic motors. A suitable hydraulic motor is sold by the Double A Products Co. of Manchester, Michigan, under the name Staffa Hydraulic Motors.

The cutter shafts 82 and 84 are provided with rigidly extending scroll-type cutter elements 90. The scroll type cutter elements 90 are rotatable with the shafts 82 and 84 relative to the support arm 80 and are arranged to dislodge material from the face of the mine as the mining machine 10 is advanced into the face and to convey the dislodged material toward the rear of the cutter head 58 onto the scraper chain conveyor 26. The separate drive motors 86 and 88 may vary the speed of rotation of the shafts 82 and 84 to continuously dislodge and remove the mined material from the face of the mine. Although scroll-type cutter elements are disclosed, it should be understood that other type cutter elements may also be utilized to dislodge material from the face.

A curtain 92 is positioned above the horizontal plate 60 and together with a vertical plate 93 of frame 61 isolate the front end of the body portion 12 from the cutter head 58. The curtain 92 extends from the horizontal plate 60 vertically upward to the roof of the mine and functions to isolate the dust created by the cutting action of the cutter head from the rear portion of the mining machine where the operating personnel are working. The dust present in the area between the curtain and the mine face is conveyed through a duct 94 by a blower or fan 96 to suitable dust collecting apparatus (not shown).

A pair of piston cylinder assemblies 98 and 100 are rigidly mounted to the vertical plate 62 of frame 61 at opposite sides of the shaft 78. Each assembly is provided with an extensible rod 102 that is suitably connected to the end of shaft 78 rotatably supported on the carriage 70. Thus, extension of the piston rod 102 of either one of the assemblies 98 or 100 rotates shaft 78 in a preselected direction. In this fashion, the support arm 80, which is secured to the shaft 78, rotates about the axis of shaft 78. Rotation of support arm 80, in turn, provides for orbital movement of the cutter shafts 82 and 84 about the axis of shaft 78.

The motors 86 and 88 rotate the cutter shafts 82 and 84 simultaneous with or independent of rotation of the shaft 78 and support arm 80. The rotation of each of the cutter shafts is, therefore, independent of the rotation of the support arm 80 and the axial shaft 78. The rotation of the respective cutter shafts 82 and 84 and the orbiting of the support arm 80, together with the lateral movement of the carriage 70 on the upper and lower guide bars 64 and 66, provide an arrangement for continuously changing the relative position of the cutter shafts 82 and 84 with respect to the mine face as the cutter head 58 traverses across the mine face. In this manner, the mining machine 10 is capable of accomplishing a varied combination of horizontal and vertical cuts in the face of the mine as further explained hereinafter.

As the self-propelled mining machine 10 advances the cutter head 58 into the face, roof support units generally designated by the numerals 106, 108 and 110 support the mine roof. The roof support units 106 and 110 are mounted in spaced relation to each other on the mining machine body portion 12, as illustrated in FIG. 1, and extend rearwardly of the cutter head 58. A transverse bridge bar 112 connects the roof support units 106 and 110 adjacent their rear end portions.

Each of the roof support units 106 and 110 include pairs of hydraulic jacks 114 (illustrated in FIG. 2) which include extensible rods 116 connected at their upper end portions to the front and rear portions of roof engaging beams 118. The beams 118 include front and rear portions which are pinned together at their adjacent end portions. With this arrangement, the hydraulic jacks 114 are operable upon actuation to raise and lower the beams 118 into and out of abutting contact with the mine roof.

The roof support unit 108 is positioned between the roof support units 106 and 110 and includes a ground engaging skid 120 that extends rearwardly from the front end portion of the mining machine body portion 12. A pair of hydraulic jacks 122 having extensible rods 124 are mounted at opposite ends on the skid 120 and are arranged to support for vertical movement a roof engaging beam 126. In a manner similar to the operation of the hydraulic jacks 114 of the roof support units 106 and 110 described above, actuation of the jacks 122 vertically extends the piston rods 124 to urge the roof beam 126 into engagement with the mine roof.

The ground engaging skid 120 is connected to the mining machine body portion 12 by a pair of hydraulic piston cylinder assemblies 128 having extensible piston rods 130 provided therein. The ends of the piston rods 130 are secured to brackets 132 that project outwardly from the body portion 12. With this arrangement, the piston cylinders 128 are operable upon actuation to extend and retract the piston rods 130 to thereby move the roof support unit 108 relative to the mining machine body portion 12 toward and away from the mine face.

During sumping operations as the mining machine 10 advances the cutter head 58 into the mine face, the beams 118 of the roof support units 106 and 110 are removed from engagement with the mine roof by retracting the piston rods 116 into the hydraulic jack units 114. The roof engaging beam 126 of the roof support unit 108, however, is maintained in abutting contact with the mine roof. Extension of the piston rods 130 from the piston cylinder assemblies 128 permits the mining machine 10 to move forwardly relative to the roof support unit 108. In this manner, the mine roof is supported by the roof engaging beam 126 as the mining machine 10 advances into the face and the cutter head 58 dislodges material therefrom.

When the sumping operation has been completed, the hydraulic jack units 114 are actuated to raise the roof engaging beams 118 of the roof support units 106 and 110 into contact with the mine roof. Then the hydraulic jack units 122 are actuated to lower the roof engaging beam 126 of the roof support unit 108 from contact with the mine roof. Thereafter, the piston cylinder assemblies 128 are actuated to retract the rods 130 and thereby advance the skids 120 forwardly toward the face while the mining machine body portion 10 remains stationary.

Upon further advancement of the mining machine to continue the sumping operation by the cutter 58, the roof support unit 108 is once again urged into roof engaging relationship with the mine roof and the roof support units 106 and 110 lowered from contact with the mine roof. With this arrangement, the roof support units 106, 108 and 110 provide continuous support of the mine roof during the sumping and continuous mining operations. Also, as illustrated in FIG. 1, roof drilling units 140 are mounted to the rear end portion of the roof support units 106, 108 and 110 to provide roof drilling for the installation of roof bolts simultaneously with the mining operation.

Figure 3:
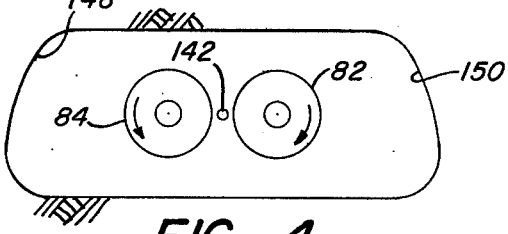
FIGS. 3–7 are schematic views of the mine face, illustrating the manner in which material is continuously removed therefrom by the mining machine having two cutter shafts as illustrated in FIGS. 1 and 2.
Figure 4:
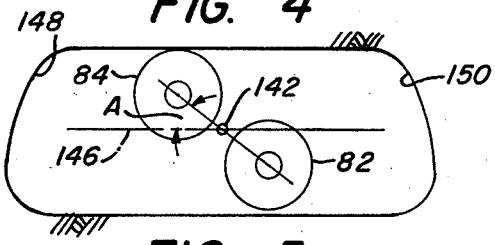

The mining machine 10 is operated to continuously dislodge material from the face of the mine in the manner illustrated in FIGS. 3–16. The self-propelled body portion 12 is positioned adjacent the mine face, and by rotation of the chain 72 on sprockets 73 and 74 the carriage 70 is moved substantially to the center of the mine face on the upper and lower guide bars 64 and 66. The boom arms 44 and 46 are lowered to position the scraper chain conveyor 26 on the mine floor. Operation of the hydraulic jack unit 63 positions the cutter head 58 at an intermediate position relative to the mine face between the roof and the floor of the mine. The drive motors 86 for each of the cutter shafts 82 are then actuated so that the scroll-type cutter elements 90 rotate at high speed with the cutter shaft 82. Simultaneously, the roof support unit 108 is positioned in engaging relationship with the mine roof, and the roof support units 106 and 110 displaced from engaging relationship with the roof. Thus, the roof support unit 108 supports the roof as the self-propelled body portion 12 advances forwardly toward the mine face so that the cutter shafts 82 and 84, positioned as illustrated in FIG. 3, penetrate a preselected depth into the face. After the cutter shafts 82 and 84 have advanced a preselected depth into the mine face, the piston cylinder assemblies 98 and 100 are actuated to extend the piston rods 102 to thereby rotate the shaft 78 in a preselected direction about the axis 142. Rotation of the shaft 78, in turn, provides for rotation of the support arm 80 through an angle A between support arm longitudinal axis 144 and the transverse axis 146, as shown in FIG. 4.

Figure 5:
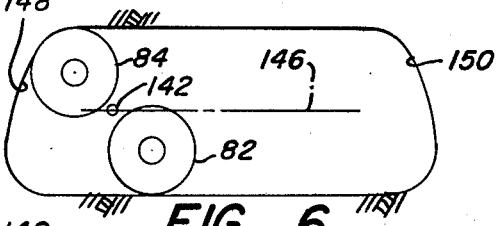
Figure 6:
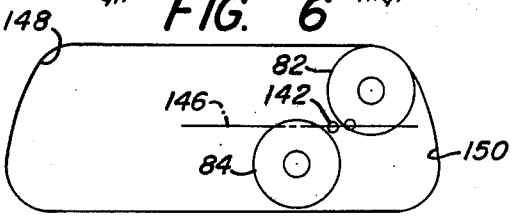

Once the support arm 80 together with the cutter shafts 82 and 84 have rotated an angle A about the support shaft axis 142 (FIG. 4), the chain 72 is rotated in a counterclockwise direction to move the carriage 70 together with the cutter head 58 laterally to dislodge material between the center of the face and rib 148, as illustrated in FIG. 5. The shaft 78 is then rotated about the axis 142 in a counterclockwise direction so that the cutter shaft 84 moves the cutting elements 90 downwardly in an arcuate path to dislodge material from the rib 148. The chain 72 is then rotated in a clockwise direction to move the carriage 70 laterally toward the opposite rib 150 with the cutting elements 90 of the shafts 82 and 84 positioned adjacent the mine roof and floor, as illustrated in FIG. 6. At the rib 150 the cutter shafts 82 and 84 and the support arm 80 are rotated in a clockwise direction about the axis 142 to dislodge solid material from the rib 150.

Figure 7:
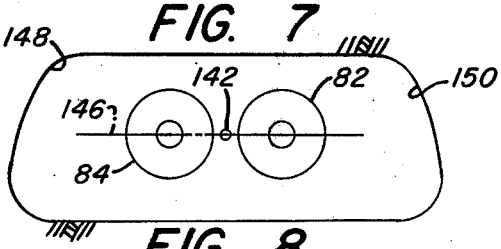
Figure 8:
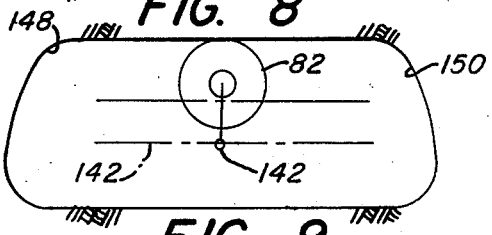
FIGS. 8–16 are schematic views of the mine face, illustrating the manner in which material is continuously removed therefrom by a mining machine having a single cutter shaft.

By rotating the shaft 78 and moving the carriage 70 on the upper and lower guide bars 64 and 66, the shafts 82 and 84 are returned to the initial sumping position as illustrated in FIG. 7. If the vein is thicker than the combined diameters of the cutter shafts 82 and 84 with the scroll-type cutting elements 90 positioned thereon, the cutter head 58 may be raised and lowered by actuation of the hydraulic jack unit 63. The operation is then repeated as above described.

When the carriage 70 is returned to center position relative to the mine face, the roof support units 106 and 110 are removed from engagement with the mine roof, and the roof support unit 108 is raised into engaging relationship with the mine roof. The mining operation is then commenced again by propelling the body portion 12 forwardly to advance the rotating cutter shafts 82 and 84 a preselected depth into the solid material of the mine face. As the miningmachine body portion 12 advances forwardly the beam 126 is maintained in abutting contact with the mine roof.

Upon completion of the sumping operation, the beams 118 of the roof support units 106 and 110 are brought into engagement with the mine roof, and the beam 126 of the roof support unit 108 retracted therefrom. The roof support unit 108 is then advanced forwardly into position for a subsequent sumping operation by actuating the piston cylinder assemblies 128. The beam 126 is then moved into roof engaging relationship with the mine roof as the continuous mining operation is completed.

For a mining machine having a single cutter shaft supported by the arm 80 on the shaft 78, as illustrated in FIGS. 8–16, the cutting height is determined by the diameter of the cutter shaft with the scroll-type cutting elements provided thereon. In the manner explained hereinabove, the cutter shaft, positioned adjacent the mine roof, is advanced a desired depth into the mine face by propelling the mining machine body portion 12 forwardly. Thereafter, the single cutter shaft is moved laterally across the face by movement of the carriage 70 on the guide rails 64 and 66 to the rib 148 of the mine passageway.

Figure 9:
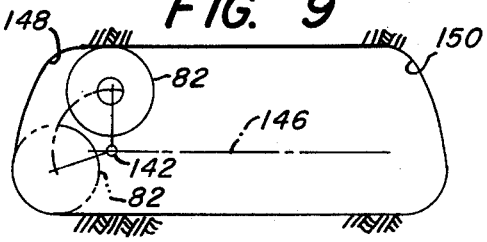
Figure 10:
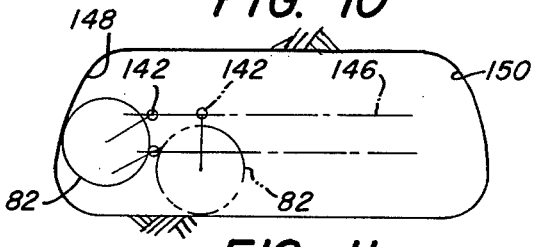
Figure 11:
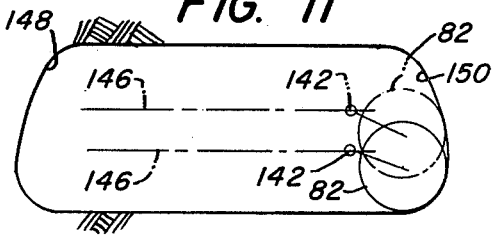

Rotation of the shaft 78, as shown in FIG. 9, provides an arcuate cut along the rib 148 from the roof to the floor. The cutter shaft is then traversed across the face toward the opposite rib 150 by movement of the carriage 70. In this manner, the remaining solid material above the mine floor is displaced, as illustrated in FIG. 10. When the cutter shaft has reached the right rib 150, rotation of the shaft 78 completes an upward arcuate cut, to dislodge the solid material from the rib 150, as illustrated in FIG. 11. Thereafter, the carriage 70 moves the cutter shaft to its original sumping position. Thus, the solid material is completely dislodged from the face of the mine in which the ribs 148 and 150 of the passageway have a generally arcuate configuration.

Figure 12:
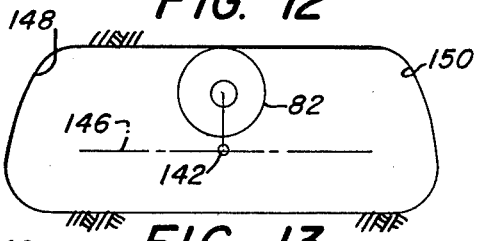
Figure 13:
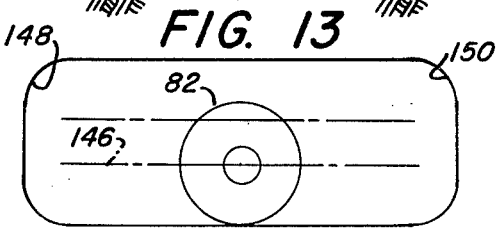
Figure 14:
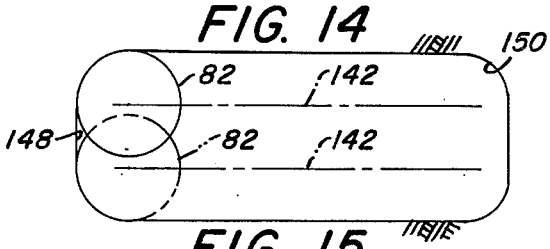
Figure 15:
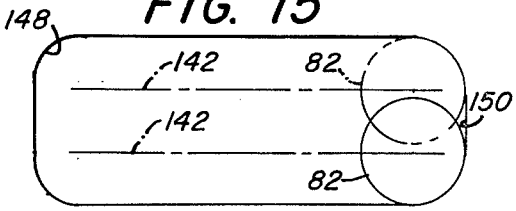
Figure 16:
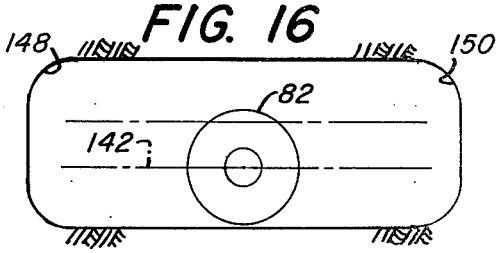

To continuously dislodge material from the mine face by a single cutter shaft forming substantially vertical ribs in the mine passageway, the cutting sequence illustrated in FIGS. 13–16 is followed. Initially, the single cutter shaft is positioned with its outer periphery adjacent the mine roof or on the mine floor, as illustrated in FIGS. 12 and 13. The cutter shaft is then traversed across the face of the mine toward the rib 148. An upward vertical cut at the rib 148 is accomplished by actuation of the hydraulic jack unit 63 to vertically raise the carriage 70 and the shaft 78 which rotatably supports the support arm 80 and the cutter shaft. Traversing the cutter shaft laterally toward rib 150, as shown in FIG. 15, completes the cut adjacent the mine roof. When the carriage 70 has moved the cutter shaft to a position adjacent rib 150, the hydraulic jack unit 63 is lowered so that a substantially downward vertical cut is made at the rib 150, as illustrated in FIG. 15. Then traversing the cutter shaft along the mine floor, as shown in FIG. 16, removes the remaining solid material from the mine face.

Regardless of the number of scroll-type cutter elements utilized on the cutter head 58 or the type of cutter element utilized to dislodge material from the face, the roof support units 106, 108 and 110 provide continuous support of the mine roof during both the sumping operations and the lateral cutting operations. Furthermore, the provision of the roof drilling units 140 at the rear portions of the roof supporting units provides the capability of simultaneously installing roof bolts in the mine roof to provide additional roof support as the mining procedure progresses. Thus, the present invention provides an efficient mining machine operable to continuously dislodge solid material from the mine face and continuously support the mine roof during the mining operation. Furthermore, as solid material is dislodged from the face, the loose material is continuously transported from the face to the rear of the mining machine body portion for removal by a material receiving vehicle during which time the roof is adequately supported by either the roof support units 106, 108 and 110 or by roof bolts which are installed in the bores drilled in the roof by the roof drilling units 140.

According to the provisions of the patent statutes, we have explained the principle, preferred construction and mode of operation of our invention and have illustrated and described what we now consider to represent its best embodiment. However, it should be understood that, within the scope of the appended claims, the invention may be practiced otherwise than as specifically illustrated and described.

We claim:

1. A mining machine comprising , a body portion having arm members pivotally secured thereto and extending forwardly therefrom, said arm members positioned in spaced parallel relation to each other, a support frame rigidly secured transversely to the front end portion of said arm members, an upper guide bar rigidly supported on said support frame and extending transversely relative to said body portion front end portion, a lower guide bar rigidly supported on said support frame below said upper guide bar and positioned parallel thereto, a carriage slidably mounted for transverse movement on said upper and lower guide bars and rotatably supporting a dislodging means, a pair of sprocket members rotatably supported at the opposite end portions of said support frame, a chain reeved about said sprocket members, said chain having end portions secured to said carriage, drive means for rotating one of said sprockets to rotate said chain and move said carriage transversely of said body portion on said upper and lower guide bars, means connected to the front end portion of said body portion for conveying dislodged material to the rear of said body portion, first vertically adjustable roof support means positioned on said body portion for supporting the roof of the mine, second vertically adjustable roof support means movably positioned relative to said body portion for supporting the roof of the mine as said body portion and said dislodging means advance forwardly in the mine, and piston cylinder means for connecting said second roof support means to said body portion for permitting relative movement between said body portion and said second roof support means as said second roof support means supports the mine roof.

2. A mining machine as set forth in claim 1 in which said second roof support means includes, a ground engaging supporting member positioned longitudinally relative to said body portion and movable on the mine floor, a horizontal beam member, means positioned on said ground engaging support member for raising and lowering said beam member into and out of abutting relation with the mine roof, and said piston cylinder means connecting said ground engaging support member to said body portion to permit relative movement between said ground engaging support member and said body portion as said body portion advances forwardly with said beam member positioned in roof supporting relation with the mine roof.

3. A mining machine as set forth in claim 2 in which said means for raising and lowering said beam member includes, a pair of hydraulically actuated jack assemblies positioned in spaced relation to each other on said ground engaging support member, said pair of jack assemblies each having an extensible rod therein, said extensible rods having upper end portions rigidly connected to said beam member and being operable upon actuation of said jack assemblies to move said beam member into and out of abutting relation with the mine roof so that said beam member supports the mine roof as said body portion advances forwardly.

4. A mining machine as set forth in claim 2 in which said piston cylinder means includes, a pair of piston cylinder assemblies, each secured at one end to said ground engaging support member and having an extensible piston rod therein rigidly connected to said body portion, said piston cylinder assemblies operable to extend said piston rods to permit forward movement of said body portion relative to said ground engaging support member so that the mine roof is supported as said dislodging means advances into the mine face, said piston cylinder assemblies operable to retract said piston rods and advance said ground engaging support member toward the mine face while said body portion remains stationary and said first roof support means supports the mine roof.

5. A mining machine as set forth in claim 1 which includes, conveyor means movable with said body portion and said first roof support means while said second roof support means is positioned in abutting relation with the mine roof.

6. A mining machine as set forth in claim 5 in which said conveyor means includes, a first conveyor portion extending transversely across said body portion front end portion and positioned rearwardly of said dislodging means for receiving material dislodged thereby, and a second conveyor portion positioned longitudinally of said body portion and connected to said first conveyor portion for receiving dislodged material therefrom and directing the dislodged material rearwardly of said body portion.

7. A mining machine as set forth in claim 1 which includes, said first and second roof supporting means selectively movable into and out of abutting relation with the mine roof to fully support the mine roof as material is continuously dislodged from the mine face.

8. A mining machine as set forth in claim 1 which includes, means supported by said first and second roof support means on said body portion for drilling holes in the mine roof simultaneously with dislodging of solid material from the mine face and supporting the mine roof by said first and second roof means.

9. A mining machine as set forth in claim 1 in which said dislodging means includes, a first shaft member having a longitudinal axis of rotation, means for rotating said first shaft member about said longitudinal axis thereof, a horizontal support arm secured to said first shaft member and transversely positioned relative to said longitudinal axis thereof, a second shaft member rotatably supported by said support arm, drive means provided on said support arm for rotating said second shaft member at a preselected speed, and cutter elements secured to said shaft for rotation therewith.

10. A mining machine as set forth in claim 9 which includes, said second shaft member rotatably supported at one end portion of said support arm, and a third shaft member having cutter elements secured thereto for rotation with said third shaft member, said third shaft member rotatably supported at the opposite end portion of said support arm, said second and third shaft members arranged to revolve about said first shaft member longitudinal axis upon actuation of said rotating means.

11. A mining machine as set forth in claim 1 in which said dislodging means includes, a first shaft member having a longitudinal axis of rotation, means for rotating said first shaft member about said longitudinal axis thereof, a horizontal support arm secured to said first shaft member and transversely positioned relative to said longitudinal axis thereof, a second shaft member rotatably supported by said support arm, drive means provided on said support arm for rotating said second shaft member at a preselected speed, and cutter elements secured to said shaft for rotation therewith.

12. A mining machine as set forth in claim 1 in which said piston cylinder means are arranged to permit relative movement between said first vertically adjustable roof support means and said second vertically adjustable roof support means so that said second roof support means supports the mine roof as said first roof support means advance forwardly during the material dislodging operation and said first roof support means supports the mine roof as said second roof support means is stationary to thereby provide continuous support for the mine roof.

13. A mining machine as set forth in claim 1 in which said first roof support means includes, horizontal beam means for engaging the mine roof to support the mine roof as said second roof support means move relative to said body portion, and means supported by said body portion and movable therewith for raising and lowering said beam means into and out of abutting relation with the mine roof.

14. A mining machine comprising, a body portion having arm members pivotally secured thereto and extending forwardly therefrom, said arm members positioned in spaced parallel relation to each other, a support frame rigidly secured transversely to the front end portion of said arm members, an upper guide bar rigidly supported on said support frame and extending transversely relative to said body portion front end portion, a lower guide bar rigidly supported on said support frame below said upper guide bar and positioned parallel thereto, a carriage slidably mounted for transverse movement on said upper and lower guide bars and rotatably supporting a dislodging means, a pair of sprocket members rotatably supported at the opposite end portions of said support frame, a chain reeved about said sprocket members, said chain having end portions secured to said carriage, drive means for rotating one of said sprockets to rotate said chain and move said carriage transversely of said body portion on said upper and lower guide bars, propelling means mounted on said body portion, said propelling means including a pair of endless ground engaging track members reeved about sprocket members rotatably mounted on said body, conveying means connected to said body portion for movement therewith and for conveying dislodged material from the front end portion to the rear of said body portion, said conveying means having a discharge end portion pivotally secured thereto to discharge dislodged material at an angle into a material receiving vehicle, first vertically adjustable roof support means connected to and movable with said body portion for supporting the roof of the mine while said body portion remains stationary, second vertically adjustable roof support means connected to and movable relative to said body portion for supporting the roof of the mine independently of said first roof support means as said body portion and said dislodging means advance forwardly in the mine and dislodge material from the mine face while said first roof support means is removed from engagement with the mine roof, said endless ground engaging track members operable to continuously advance said body portion and said first vertically adjustable roof support means as said dislodging means dislodges solid material from the face of a mine, and piston cylinder means for connecting said second roof support means to said body portion, said piston cylinder means being operable to permit relative movement between said body portion and said second roof support means such that said second roof support means supports the mine roof as said body portion and said first roof support means advance forwardly during the material dislodging operation and said first roof support means supports the mine roof as said second roof support means is retracted and advanced toward the mine face when said body portion is stationary to thereby provide continuous support of the mine roof.

* * * * *